United States Patent [19]

Housman

[11] 4,296,868

[45] Oct. 27, 1981

[54] HOUSING FOR DRAFT GEAR

[75] Inventor: Richard J. Housman, Dolton, Ill.

[73] Assignee: Westinghouse Air Brake Company, Pittsburgh, Pa.

[21] Appl. No.: 96,342

[22] Filed: Nov. 21, 1979

Related U.S. Application Data

[63] Continuation of Ser. No. 841,769, Oct. 13, 1977, abandoned.

[51] Int. Cl.[3] ..... B61G 9/20

[52] U.S. Cl. ..... 213/50; 213/51

[58] Field of Search ..... 213/22, 24, 32 A, 32 R, 213/32 C, 33, 40 R, 44, 46 R, 47, 49, 34, 50, 51; 267/138; 220/70, 71, 72; 74/606 R

[56] References Cited

U.S. PATENT DOCUMENTS

| | | | |
|---|---|---|---|
| 1,255,916 | 2/1918 | Newell | 213/22 |
| 1,571,652 | 2/1926 | Strid | 213/22 |
| 1,621,517 | 3/1927 | O'Conner | 213/32 A |
| 1,683,397 | 9/1928 | O'Conner | 213/24 |
| 1,700,229 | 1/1929 | Lounsbury | 213/24 |
| 1,742,004 | 12/1929 | O'Conner | 213/24 |
| 1,939,652 | 12/1933 | Barrows | 213/22 |
| 2,271,080 | 1/1942 | Kinne et al. | 213/32 R |
| 2,623,743 | 12/1952 | Mulcahy | 213/32 R X |
| 2,906,415 | 9/1959 | Andrew et al. | 213/24 |
| 2,916,163 | 12/1959 | Campbell | 213/33 |
| 2,925,924 | 2/1960 | Morley | 213/32 R |
| 3,077,284 | 2/1963 | McLaughlin | 220/72 |
| 3,263,521 | 8/1966 | Muller | 74/606 |

*Primary Examiner*—Kenneth Dorner
*Attorney, Agent, or Firm*—J. B. Sotak

[57] ABSTRACT

In a draft gear apparatus, the housing is strengthened to better withstand distortion by draft stress imposed by the yoke on the end of the housing. Strengthening is accomplished by increasing the thickness of the housing side walls at selected areas near the housing end and by widening and thickening portions of the ribs which partially define the main spring chamber.

3 Claims, 28 Drawing Figures

PRIOR ART

PRIOR ART

PRIOR ART

PRIOR ART

PRESENT INVENTION

PRESENT INVENTION

HOUSING FOR DRAFT GEAR

This is a continuation of application Ser. No. 841,769, filed Oct. 13, 1977, now abandoned.

SUBJECT OF THE INVENTION

This invention relates to high capacity draft gear apparatus, and, more particularly, to the housing unit which encloses the draft gear, the housing unit including strengthening means to better withstand draft stresses imposed thereon by the yoke.

BACKGROUND OF THE INVENTION

Heretofore, as disclosed and claimed in U.S. Pat. No. 2,916,163, granted Dec. 8, 1959 to David S. Campbell, there has been constructed a high capacity draft gear, which, generally speaking, utilizes in a housing a friction cushioning element in tandem with a coil spring cushioning element and longer gear travel is accommodated with a conventional type of coil spring cushioning element by utilizing a guide stem that is movable with the follower for the coil spring element to cooperate with the spring element and give it necessary columnar stability during compression. During release, the coil spring aligns the guide stem, which cooperates with an intermediate follower for preventing tipping of this follower, thereby avoiding binding or sticking of the gear. Additional capacity is achieved through longer travel and through the use of corner coil springs mounted in individual spring chambers that extend parallel to the main coil spring chamber. The action of the friction system throughout the gear closure absorbs sufficient energy to maintain reaction pressures on the car within required limits.

As is well known, draft gears are subjected to two major types of loading, namely buff and draft. The buff loading occurs during train make up, train operations, train braking, and "in train action" to compensate for relative motion between railroad cars. This type of loading manifests itself in a coupler shank compressive force which is transmitted to the follower block which, in turn, distributes the loading among the center wedge and two movable plates in the draft gear. This force is transmitted through the friction clutch mechanism and is borne by the housing walls which are supported by the rear lugs of the draft gear pocket in the car.

On the other hand, draft loading occurs during locomotive tractive actions as well as "in train action" to compensate for relative motion between railroad cars. This type of loading manifests itself in a coupler shank tensile force which is transmitted through the coupler key and yoke to the draft gear housing end. This force is transmitted from the housing end through the housing walls, friction clutch mechanism, and follower block which is supported by the front lugs of the draft gear pocket of the car.

In the draft gear design of the aforementioned U.S. Pat. No. 2,916,163, the yoke bears against the center-section of the draft gear end where the load is distributed outward to the walls of the housing. Because of the rigid connection between the bottom portion of the housing and the walls, a bending moment is transmitted into the side walls causing them to flex.

Service conditions existing at the time the aforementioned draft gear design was constructed and placed into service involved applications to 70-ton rail cars with relatively low utilization and shorter train lengths.

Consequently, a reasonable number of years of service could be expected from the draft gear. Subsequently, with the introduction of unit trains, increased car capacity and utilization, and longer train lengths have all contributed to increased magnitude and number of draftbuff fatigue cycles on the draft gear. Even today in normal rail car service, the aforementioned draft gear design is satisfactory and provides a reasonable life.

Under severe service conditions, however, the housing side wall flexure is increased which reduces the fatigue life of the draft gear.

Accordingly, the object of the present invention is to increase the fatigue life of the draft gear housing.

Another object of the invention is to strengthen the draft gear housing against a side wall flexing face imposed by the yoke under draft bearing against the housing end.

Yet another object is to increase the rigidity of the housing side walls by increasing the cross-sectional areas of the main spring guide ribs to better support the housing end against draft force induced by the yoke.

These and other objects of the invention will become more readily apparent in the following description taken with the accompanying drawing, in which FIGS. 1 through 19 are prior art and correspond to the drawing FIGS. 1 through 19 comprising the drawings in the aforementioned U.S. Pat. No. 2,916,163, of which:

FIGS. 20 through 28 illustrate the present invention, in which:

FIG. 20 is a vertical sectional view taken along the longitudinal axis of a draft gear housing showing the present invention;

FIG. 21 is a horizontal sectional view taken along the longitudinal axis of the housing shown in FIG. 20;

FIG. 22 is a sectional view of the housing taken along the line 22—22 of FIG. 21;

FIG. 23 is a sectional view of the housing taken along the line 23—23 of FIG. 21;

FIG. 24 is a sectional view of the housing taken along the line 24—24 of FIG. 21;

FIG. 25 is a sectional view taken along the line 25—25 of FIG. 21;

FIG. 26 is a sectional view of the housing taken along the line 26—26 of FIG. 21;

FIG. 27 is a sectional view of the housing taken along the line 27—27 of FIG. 21; and FIG. 28 is a sectional view of the housing taken along the line 28—28 of FIG. 21.

In order to promote the fullest understanding of the present invention, the prior art high capacity draft gear illustrated in FIGS. 1 through 19 will first be described.

Figure 1:
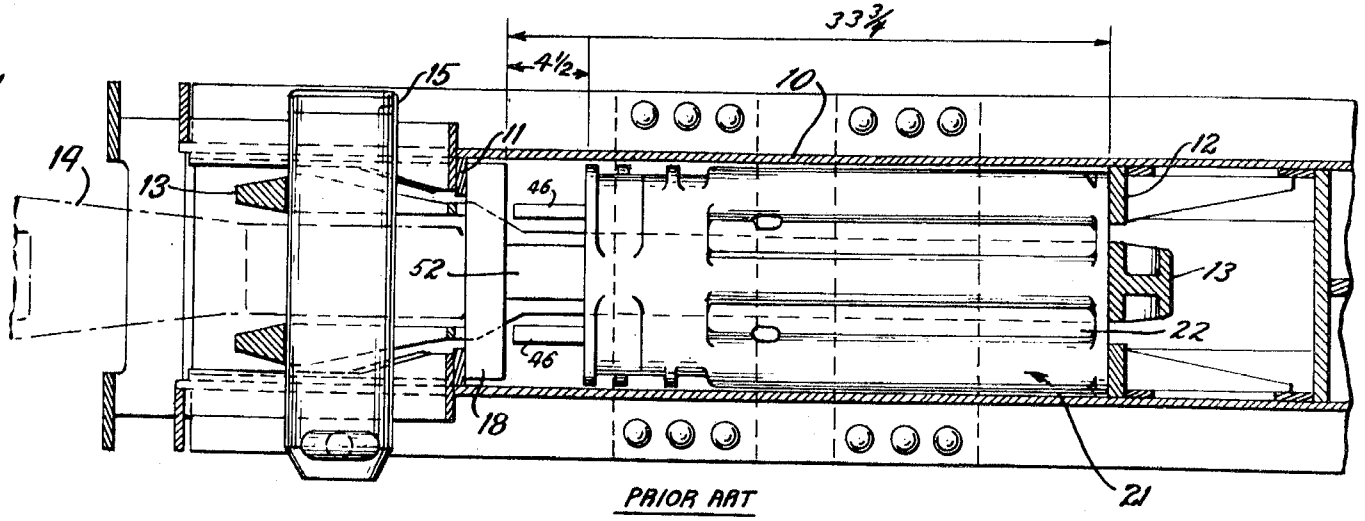
FIG. 1 is a horizontal section through familiar parts of a freight car showing the draft gear mounted in a draft gear pocket in association with the draft gear attaching devices.
Figure 2:
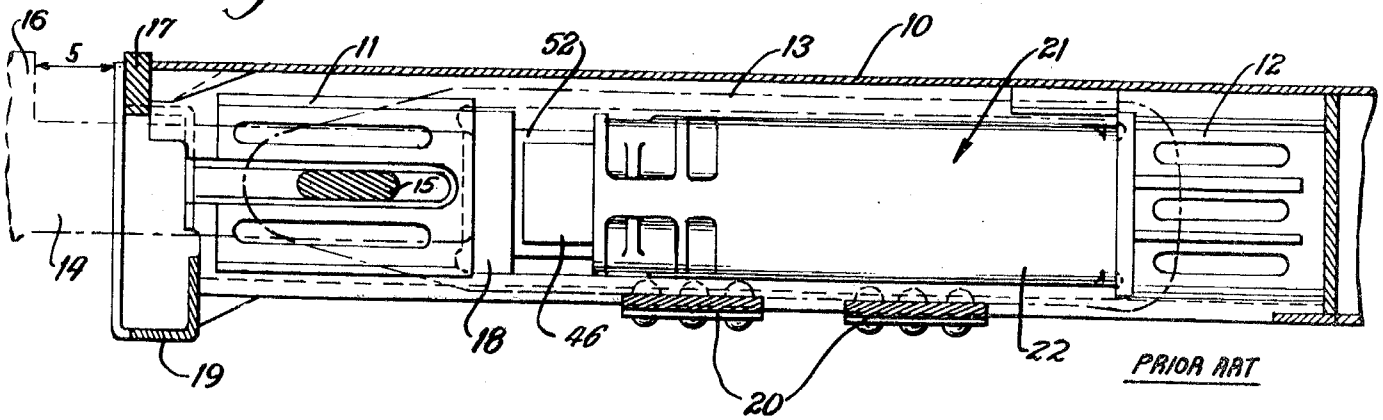
FIG. 2 is a vertical section through the same.

In FIGS. 1 and 2, there are shown center sills 10, front and rear draft gear lugs 11 and 12 respectively, a vertical yoke 13 connected to a coupler shank 14 by a draft key 15, in the positions they assume in full release, with a coupler horn 16 spaced from a striking plate 17 and with a front follower 18 within the yoke 13 and against the front lugs 11, all substantially in accord with conventional practice. The coupler carrier iron is shown at 19 and the draft gear carrier irons are shown at 20, there being two required due to the length of the draft pocket.

As illustrated in FIG. 2, the draft pocket is 36" in length in accordance with recently revised specifications of the Association of American Railroads. The present gear when in its full release condition is 33¾" long and accommodates a nominal gear closure travel of 4½". In this connection, it will be noted that the coupler horn 16 is spaced a full 5" in front of the striking plate 17. This 4½" travel represents a significant increase over the former maximum travel of 2¾" and makes it possible to greatly increase draft gear capacity for better handling of the high energy buffing shocks so common in present day freight yard switching practice.

The prior art draft gear, generally designated as 21, includes a housing 22 having a rear chamber 23 for a spring cushioning mechanism, generally designated as 24, and a front chamber 25 for a friction cushioning mechanism, generally designated as 26, with the front chamber being in open communication with the rear chamber and having an opening 27 through the front of the housing.

The draft gear housing 22 (FIGS. 6, 7 and 8) is an oblong, rectangular, hollow steel casting having top, bottom and side walls designated respectively 28, 29 and 30, with the portions of the top and bottom walls that define the rear chamber each being formed with a pair of laterally spaced apart, parallel, longitudinally extending ribs 31 and 32. The ribs 31 and 32 partially define a main spring chamber in which is mounted a conventional triple-coil spring arrangement consisting of helical springs 34, 35 and 36 which are adapted to be compressed against the rear wall 37 of the housing. In addition, the ribs 31 partially define an auxiliary spring chamber, the top and bottom portions of which receive individual corner coil springs 38, while the ribs 32 partially define a complementary auxiliary spring chamber, the top and bottom portions of which receive individual corner coil spring 39. The auxiliary spring chambers are spaced apart laterally and extend parallel to the main spring chamber on opposite sides thereof. The corner coil springs are also adapted to be compressed against the rear wall 37.

An intermediate follower and wedge member 40 (FIG. 11) is located forwardly of the cushioning mechanism in the rear chamber and includes a base plate 41 that provides a spring seat for the triple-coil spring arrangement while auxiliary spring seats 42 (FIG. 13) are disposed in the auxiliary spring chambers between the corner springs and the base plate 41. As shown, each of the auxiliary spring seats cooperates with two corner springs; and while this arrangement takes optimum advantage of the guiding action of the ribs 31 and 32 and better synchronizes the operation of the parallel corner spring elements, it is recognized that individual auxiliary corner spring seats can be provided for each corner spring.

In the front chambers 25 of the housing and forwardly of the base plate 41 is the friction mechanism 26 including groups of intercalated plates, of which 44 and 45 are stationary and 46 is movable. Between the stationary plates 45 of each group are a pair of laterally spaced apart wedge shoes 47 having oppositely outwardly facing surfaces 48 cooperating with the inwardly facing friction surfaces 49 of the stationary plates 45. The wedge shoes 47 have forward wedge surfaces 50 cooperating with similar wedge surfaces 51 on a central plunger 52 and rearward wedge surfaces 53 cooperating with like surfaces 54 formed on the forward end of a chambered box-shaped casting 55 that projects forwardly from base plate 41. The wedge surfaces 54 are shown as being carried integral with the intermediate follower 40 and while this is preferred, it is permissible for these parts to be separate.

The box-shaped casting 55 includes longitudinal reinforcing ribs 57 that define a central guiding chamber that is open at both ends with its forward opening 58 being coaxial with, but somewhat larger than, its rearward opening 59.

A stepped tubular guide stem 60 (FIG. 12), of preferably cylindrical form is disposed within the guide chamber with its larger front end portion 61 in guiding cooperation with the ribs 57 and with its smaller rear end portion 62 projecting through the opening 59 in base plate 41 and telescoped within the central coil spring 36. The guide stem includes an intermediate transverse wall 63 that bears against the marginal wall portions surrounding opening 59. A minimum design clearance is provided between the rear portion 62 of the stem and coil spring 36 that normally avoids contact therebetween. There is a positive guiding action between the ribs 57 of the chambered casting 55 and the stem 60 that normally maintains the stem in properly centered axial relationship with the draft gear housing such that the stem resists any tendency for the central coil spring 36 to deflect laterally. In this connection, it may also be noted that ribs 31 and 32 in the rear chamber provide a similar stabilizing influence on the outer coil spring 34. Thus columnar stability is achieved.

The central plunger 52 includes a pair of vertically spaced, rearwardly extending, parallel arms 64 that are bridged by a transverse wall 65 which forms a spring seat 66 for one end of a coil spring 67, the other end of which seats against the transverse wall 63 of the guide stem 60. The spring 67 thus reacts between the coil spring cushioning mechanism 23 and the plunger 52 to constantly urge the plunger 52 toward its release position.

ASSEMBLY

In assembling the gear, the auxiliary spring seats 42 and the associated corner springs 38 and 39 are first located in place within the gear and then the triple-coil springs and intermediate follower and wedge member 40 are inserted through the front end of the housing. To facilitate assembly, the housing 22 (FIG. 8) is provided with openings 68 through which assembly pins may be inserted for engaging the intermediate follower and wedge member 40 after suitable compression of the coil spring cushioning mechanism, and this gives ample clearance for assembling the friction devices. First, the guide stem 60 is inserted, then the stationary plates 44 and 45, then the wedge shoes 47, the spring 67 and the central plunger 52 which is first rotated toward the horizontal position to enter the open front of the housing 22 and is then brough to vertical position in order to bring its projections 69 (FIG. 10) into the position they appear in FIG. 4. Finally, the movable plates 46 are inserted.

Stationary plates 44 are held by vertical ribs 70 and 71 formed on the side walls 30 of the housing and stationary plates 45 are held by horizontal ribs 72 and 73 carried by the top and bottom walls of the housing.

In order to shorten the gear temporarily for insertion into the draft gear pocket, the projections 69 are provided with pointed forward ends 74. After a few normal operations of the gear, these pointed ends cut into the housing and allow full release of the gear between the lugs 11 and 12.

OPERATION

Figure 3:
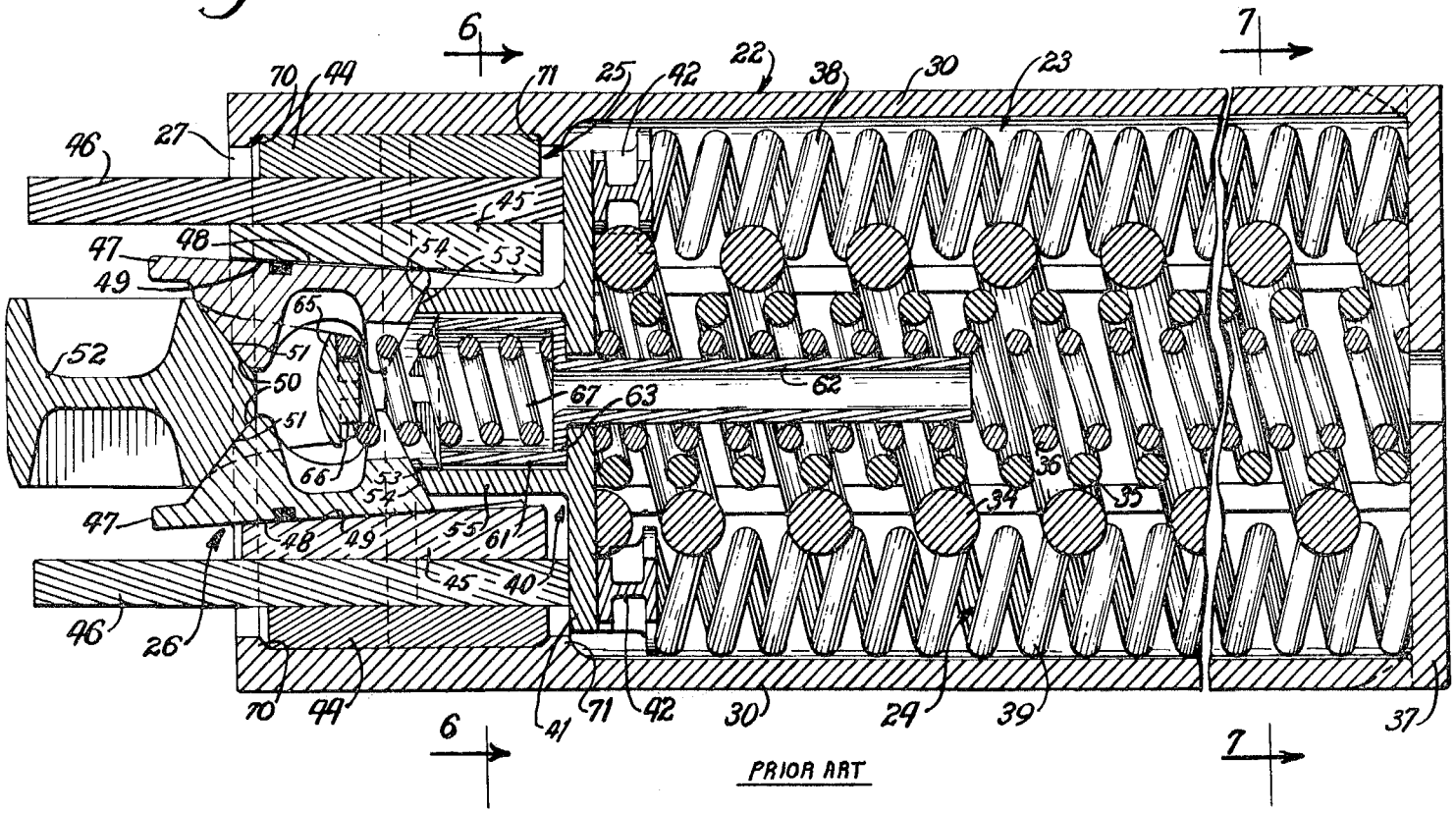
FIG. 3 is an enlarged horizontal section through a draft gear of increased capacity and travel made according to the invention with the draft gear being shown in full release.
Figure 4:
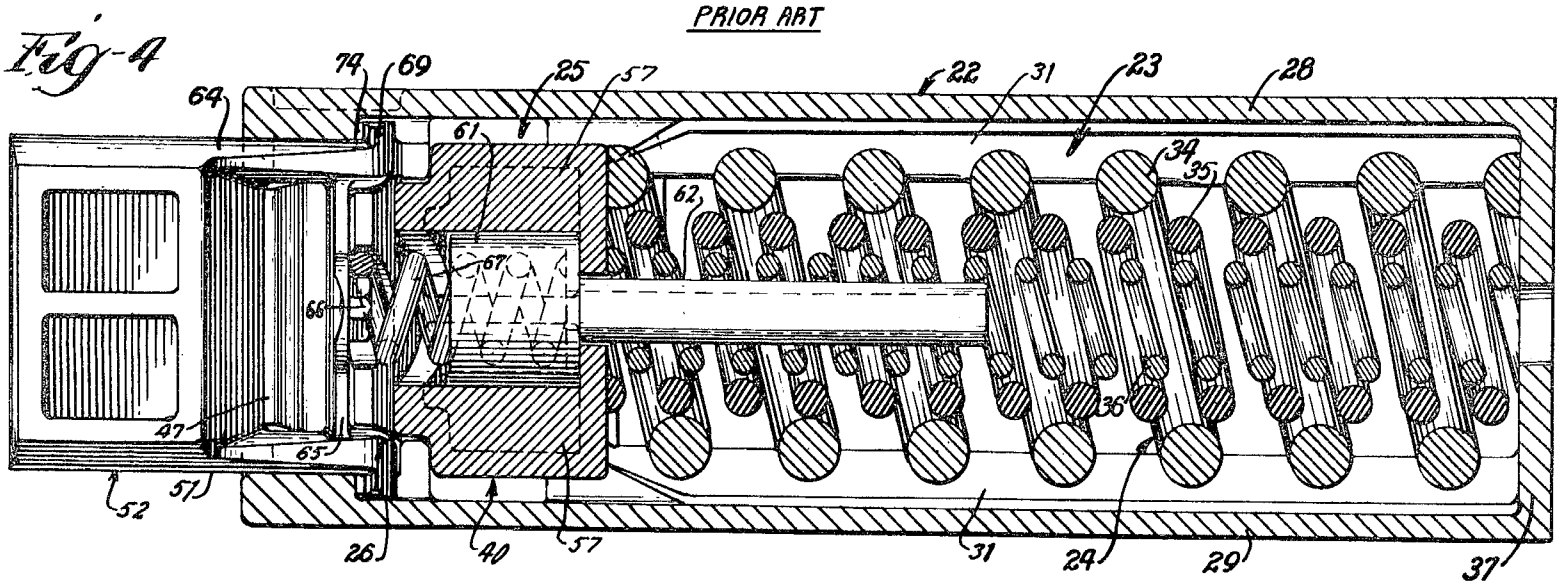
FIG. 4 is a vertical section along the medial line of the draft gear in full release.
Figure 13:
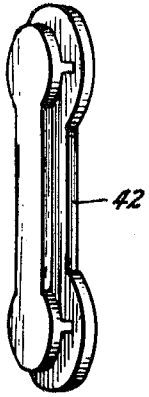
Fig-13 PRIOR ART
FIG. 13 is a perspective view of an auxiliary spring seat.
Figure 5:
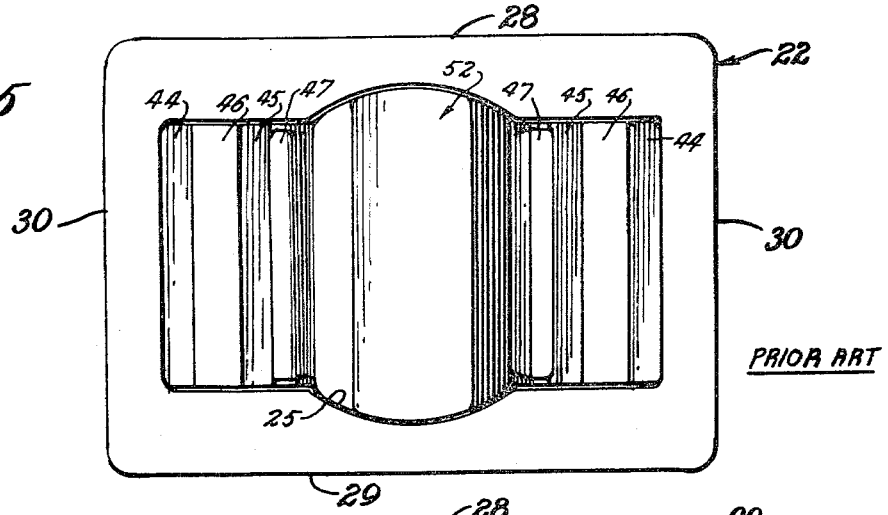
FIG. 5 is a front end view of the draft gear.
Figure 6:
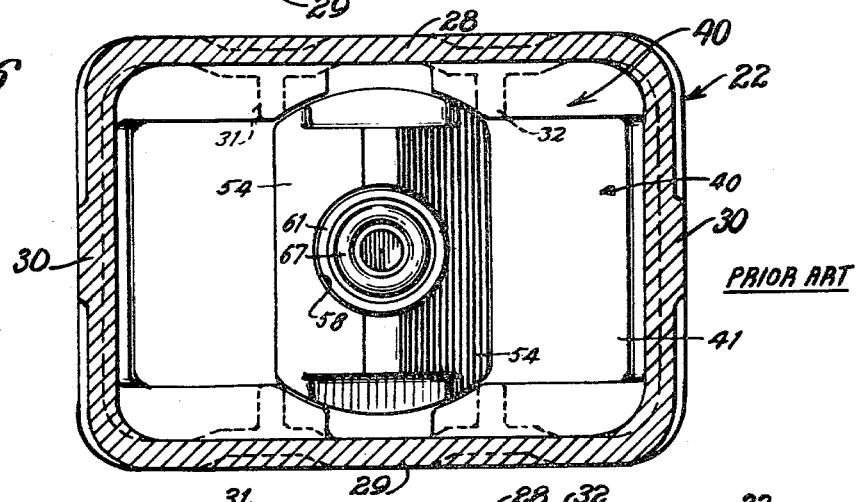
FIG. 6 and FIG. 7 are vertical sections taken respectively along the lines 6—6 and 7—7 of FIG. 3.
Figure 7:
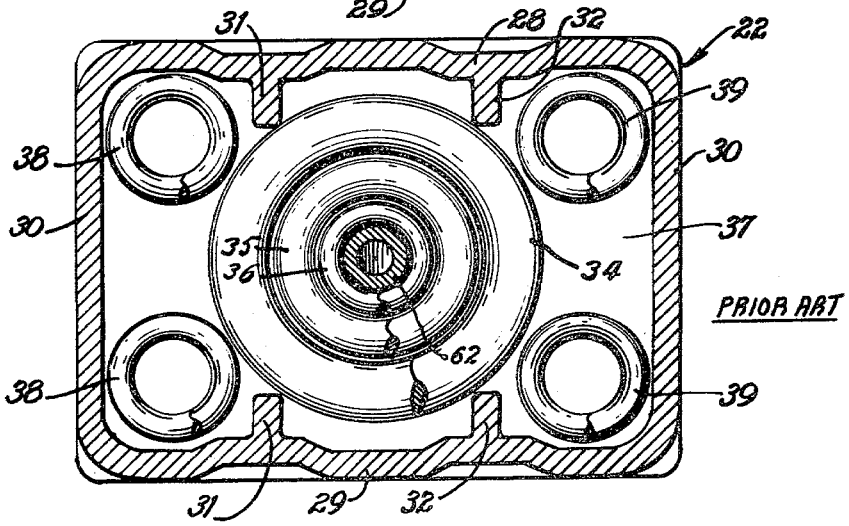
Figure 8:
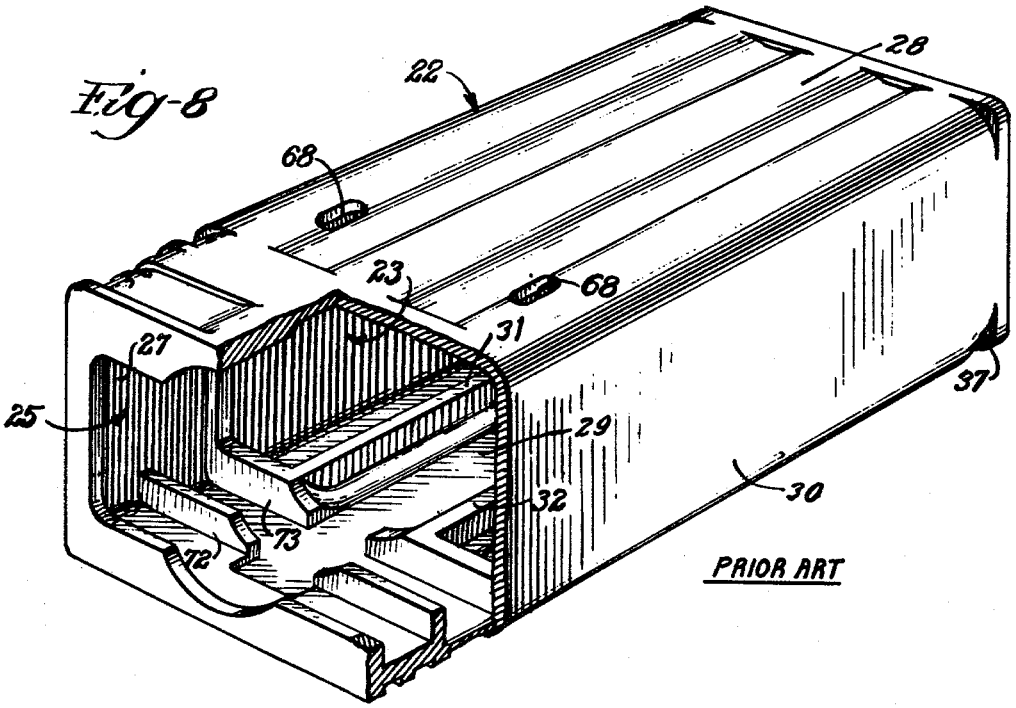
FIG. 8 is a perspective view of the draft gear housing.
Figure 9:
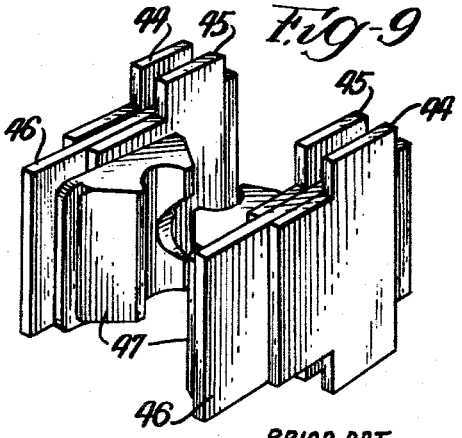
PRIOR ART Fig-9
FIG. 9 is a perspective view of the friction plates and wedge shoes.
Figure 10:
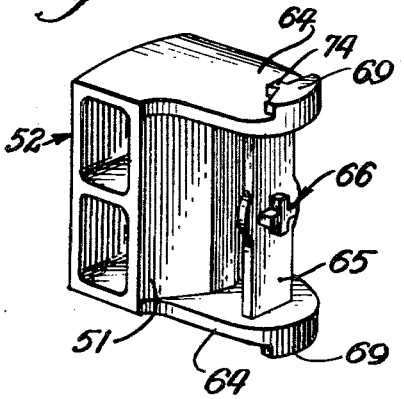
PRIOR ART Fig-10
FIG. 10 is a perspective view of the central plunger.
Figure 11:
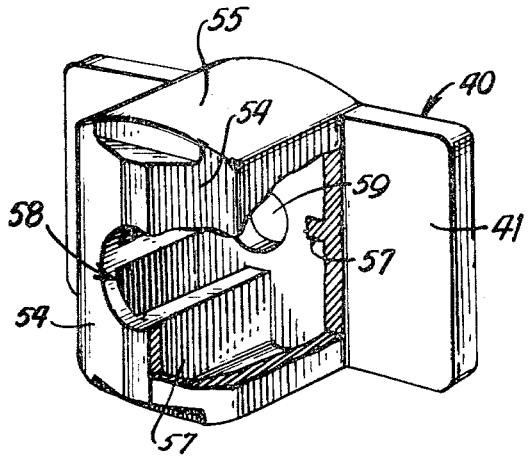
PRIOR ART Fig-11
FIG. 11 is a perspective view of the intermediate follower and wedge member.

In operation, the buffing shock is transmitted from the coupler 14 through the front follower 18 to the central plunger 52, forcing it to the right as viewed in FIGS. 3 and 4, causing it to act through the wedge shoes 47 and the chambered casting 55 to transmit the travel to the intermediate follower plate 41 and compress all of the coil spring cushioning elements simultaneously. These parts will furnish sufficient cushioning for light buffing shocks. After suitable travel, however, on the order of ½", the follower will come against the outer ends of the movable plates 46 introducing energy-absorbing friction between the movable plates 46 and the stationary plates 44 and 45 which have been pressed together by the action of the wedge shoes 47. As this action continues, the pressure between the adjacent surfaces of the intercalated plates has been enormously increased due to the fact that the wedge shoes are loaded against the cushioning mechanism 23. The energy absorption and dissipation through friction and compression of the cushioning mechanism continues until the gear is closed.

Figure 14:
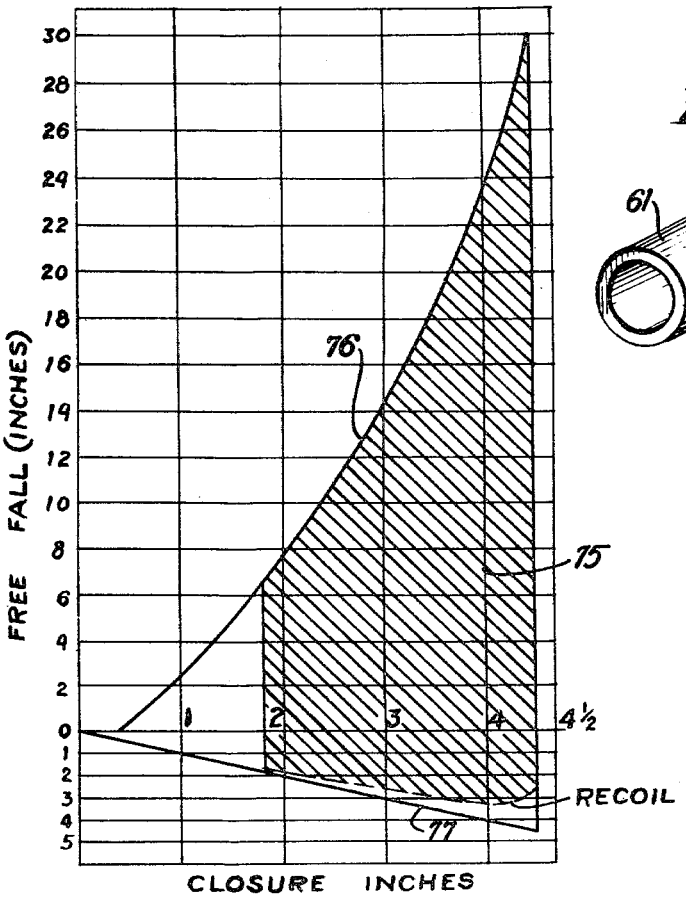
FIG. 14 is a capacity drop test curve for the gear.
Figure 12:
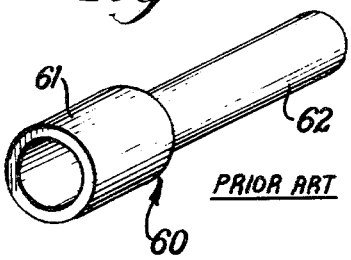
PRIOR ART Fig-12
FIG. 12 is a perspective view of the guide stem.

With the additional travel afforded by the longer draft pocket construction during all of which the friction system is active and is increasing in effectiveness as the gear closes, the present gear offers a huge increase in capacity over all known gears and as may be determined from the characteristic curve shown in FIG. 14, the capacity of this gear is on the order of 80,000 foot pounds. It is important to note that the action of the friction system permits this to be accomplished without exceeding a 500,000 pound reaction pressure on the car sills and thus these high energy shocks are readily handled without upsetting the coupler shank. The curve shown in FIG. 14 is based on the standard A.A.R. capacity drop-test and the cross-hatched area 75 between the closure curve 76 and the recoil curve 77 represents the amount of energy absorption.

In cross section, the draft pocket remains at the usual 12⅝" by 9" dimensions and since the 33¾" draft gear of the present invention must be arranged within these limits, the cross-sectional sizes of the coil springs must be retained substantially the same as in the past and yet these springs are of far greater length and provide greatly increased travel.

Under these circumstances and in view of the high shocks to which they are subjected, the problem of columnar stability of the coil springs is an important one. According to the prior art invention, a maximum of cushioning capacity is achieved by means of the ribbed housing constructions which permit corner springs to be accommodated and guided during their compression and expansion. The guiding action is provided by the cooperation between the ribs 31 and 32 and the corner springs themselves and even more importantly by the cooperation between these ribs and the auxiliary spring seats for the corner springs. The ribs 31 and 32 also provide a guiding action to the outer spring 34 of the triple-coil group and, in conjunction with the action of the guide stem 60, provide necessary stability to the triple-coil group during compression of the gear. The guide stem in turn cooperates with the chambered casing 55 of the intermediate follower 40 to insure that the guide stem is properly centered. Finally, the guide stem itself forms a seat for release spring 67.

During release of the gear, the coil springs maintain the alignment of the guide stem, which, in turn, prevents tipping of the intermediate follower. It will be appreciated that the difficulty of providing a number of coil springs with identical release characteristics holds out a continuing possibility of the follower plate's becoming cocked or tipped during release of the gear such as could result in binding or sticking of the gear.

ALTERNATIVE EMBODIMENTS

Figure 15:
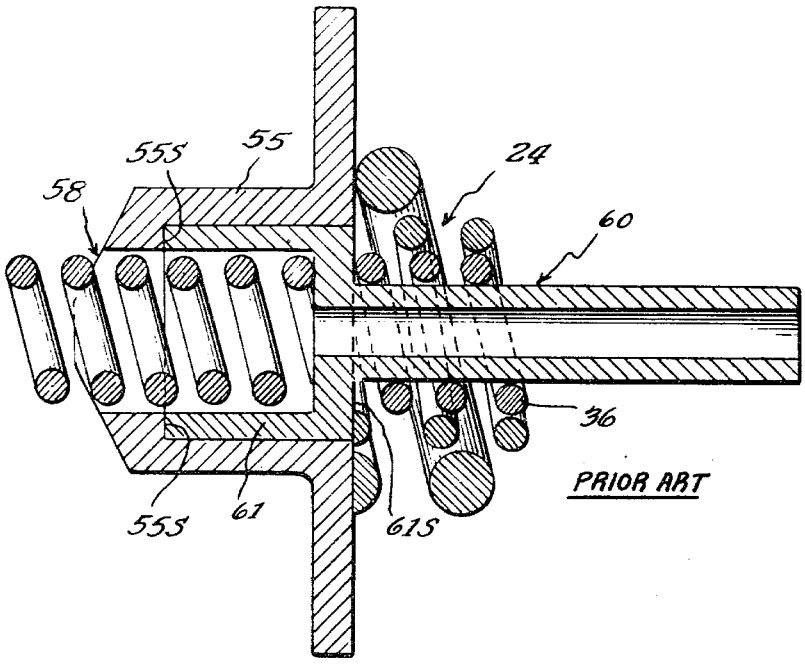
FIG. 15 is a fragmentary horizontal section illustrating an alternative constructional embodiment of a draft gear in accordance with this invention.
Figure 17:
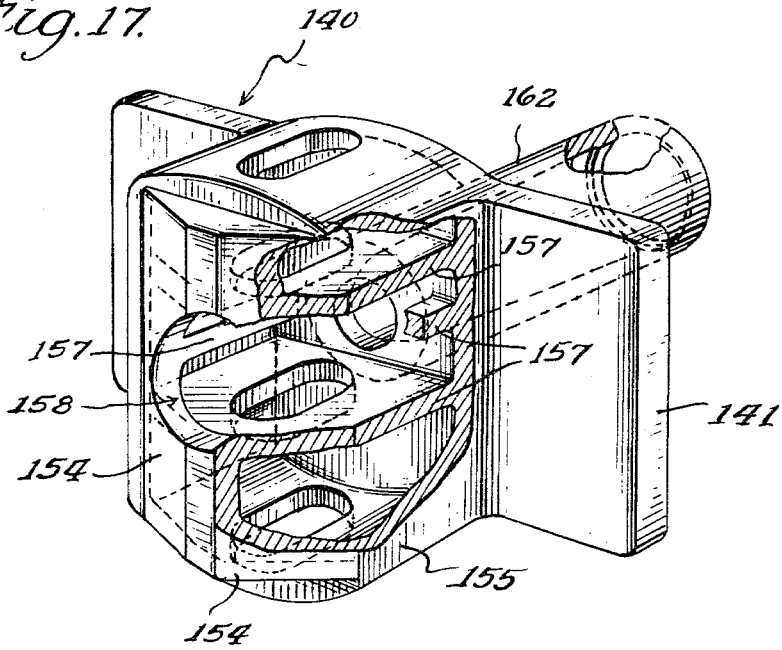
PRIOR ART Fig. 17.
FIG. 17 is a perspective view of the one-piece intermediate follower and guide stem structure of the embodiment of FIG. 16.
Figure 16:
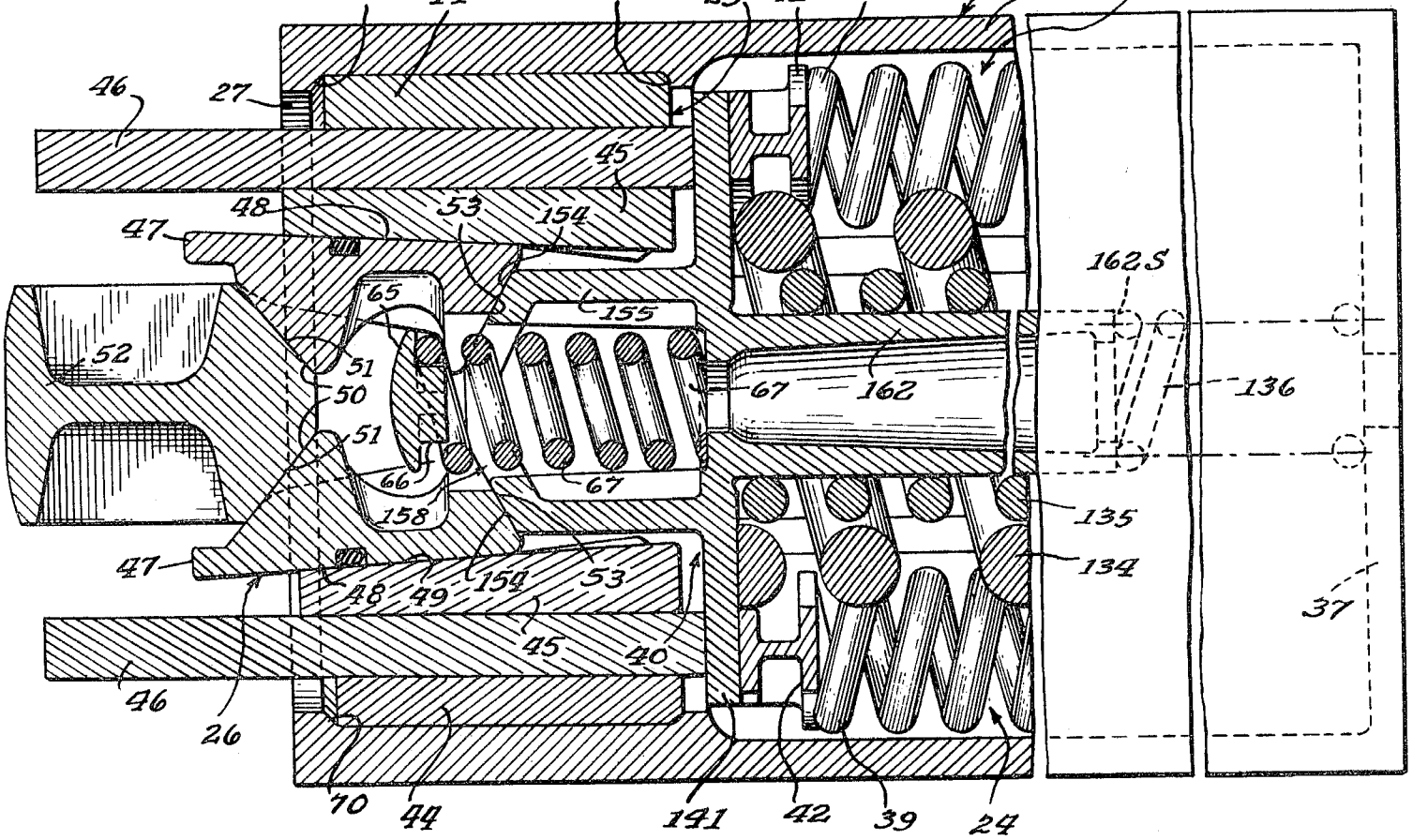
Fig. 16. PRIOR ART
FIG. 16 is an enlarged horizontal section illustrating still a further and preferred constructional embodiment of a draft gear made in accordance with this invention.

The intermediate follower and guide stem structure may be variously embodied within the scope of the teachings of this invention, and two alternative embodiments of this structure are shown in FIGS. 15 and 16, respectively. The general arrangement of these alternative embodiments is similar to that previously described, and corresponding parts are assigned identical reference characters for convenience of disclosure.

In the alternative embodiment shown in the fragmentary horizontal sectional view of FIG. 15, the guide stem 60 may be essentially identical in form to that of the previously described embodiment; however, the rear surface 61S of the front end portion 61 now functions as a spring seat for the innermost coil spring 36 of the spring cushioning assembly 24. This innermost coil spring 36 therefore urges the guide stem towards the open front end 58 of the box-shaped casting 55, which is formed with internal shoulders 55S for abutting coaction with the guide stem. Once again, the guide stem cooperates with the internal ribs of the box-shaped casting for maintaining the stem and casting in properly centered relation within the draft gear housing such that the stem normally resists any tendency for the center coil spring 36 to deflect laterally under compression loading. Again, there is a further important feature derived from this intermediate follower and guide structure in that the center coil spring 36 acts upon the stem portion 62 during release of the gear to cause the stem portion 62 during release of the gear to cause the stem portion 61 to remain centered and, by its interaction with the casting 55, to prevent any tendency for the intermediate follower to tip or cock about a transverse axis.

The embodiment of FIG. 16 illustrates the preferred commercially tested and approved structure of the present invention, and its employs a one-piece intermediate follower and guide stem structure 140 (see FIG. 17) having a transversely arranged base plate 141 providing a spring seat for the coils 134 and 135 of a double-coil main spring cushioning element. Integrally connected to the base plate is a rearwardly extending stem portion 162 and a forwardly extending, box-shaped, chambered casting 155. The corner regions of the base plate are again arranged to abut the auxiliary spring seats 42 for the sets of corner springs 38 and 39. The base plate also extends inwardly of the periphery of the chambered casting 155 to provide a spring seat for the release spring 67. The box-shaped chambered casting 155 is provided with lengthwise extending internal reinforcement walls 157; and at its forward end it again terminates in cooperating wedge-like surfaces 154, with the casting opening through these wedge surfaces as indicated at 158 to accommodate the release spring 67.

It will be apparent that the rearwardly projecting guide stem 162 of this embodiment is of increased diameter when compared with the foregoing arrangements so that only a doublecoil main spring cushioning element may be accommodated within the cross-sectional dimensions of the gear housing 22. This stem extends a distance of approximately six inches from the transverse plane of the base plate 141 and is provided with inward end shoulders 162S forming a seat for an additional spring 136 that is arranged to act between the rear housing wall 37 and the end of the stem 162. This additional spring 136 makes effective use of the available space behind the stem and gives a measure of added capacity to the gear.

The one-piece follower and guide structure offers the advantages of inherently greater strength and a more secure and reliable guiding action, and it functions in essentially the same fashion as the two-piece follower and guide structure of the embodiments of FIGS. 3 and 15.

During compression of the gear, the guide stem 162 cooperates with the innermost coil spring 135 to insure desired columnar stability of this spring. During release, the spring 135 acts upon the stem 162 to maintain the longitudinal alignment of the follower and guide structure 140 and resist any tendency for the follower to become cocked or tipped, a condition which could lead to binding or sticking of the gear. The remaining components, such as the friction system, the release spring 67, and the corner springs and associated auxiliary seats, functions in the same manner as described previously.

Figure 18:
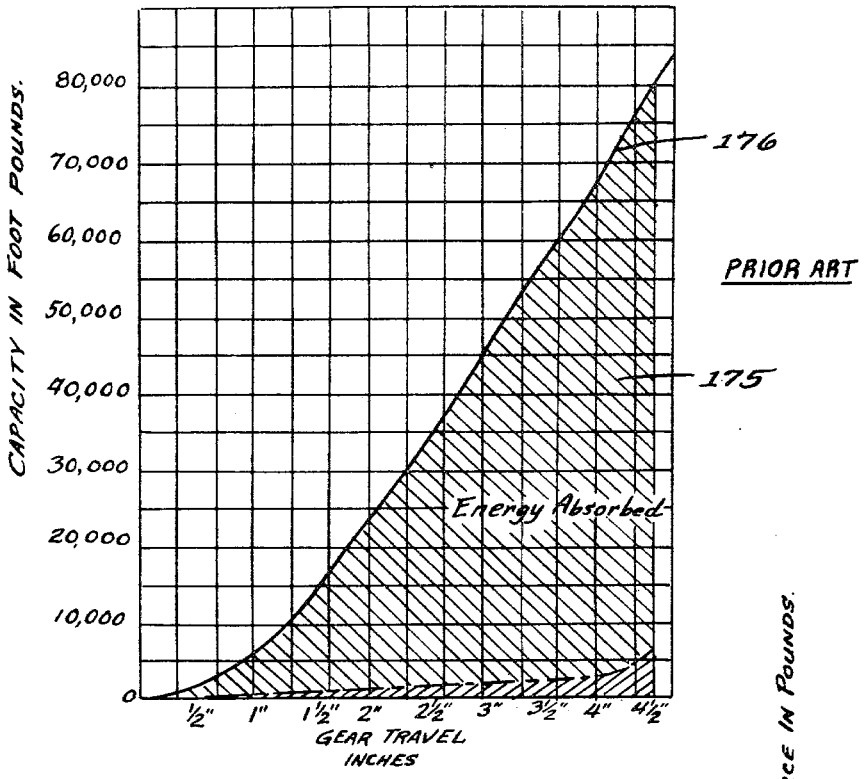
FIGS. 18 and 19 are actual test curves for the embodiment of the gear shown in FIG. 16.
Figure 19:
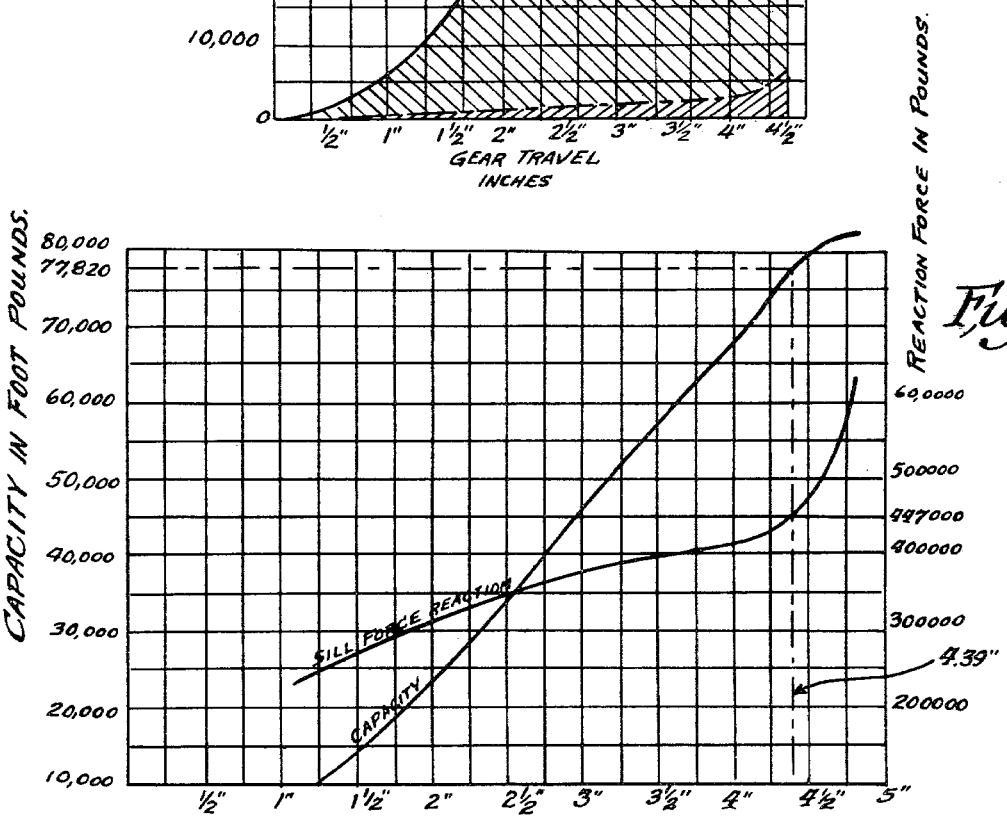
PRIOR ART Fig. 19.

The performance curves for the gear of FIG. 16 are shown in FIGS. 18 and 19. FIG. 18 is a capacity curve and the shaded portion 175 under the curve 176 is a measure of the energy absorbed during closure of the gear. FIG. 19 shows a curve of the reaction force to which the car sill is subjected, together with the gear capacity curve for a range of gear closure travel, and the dot-dash lines on this curve illustrate that in tests made in accordance with the A.A.R. specification M-901C-56, the gear of FIG. 16 to the capacity of 77,820 foot pounds over a 4.39" gear closure travel with a reaction force to the car sills of only 447,000 pounds.

Having above described the draft gear apparatus in the prior art U.S. Pat. No. 2,916,163, it is to be understood that the problem encountered in attempting to strengthen the draft gear housing thereof against draft force is one which must be solved within the severe limitations of space exteriorly and interiorly of the housing. To thicken the housing wall by adding material in a direction exteriorly of the prior art housing is impractical because of the size limitations of the draft gear pocket in which the housing is disposed. To uniformly thicken the housing walls by adding material in a direction interiorly of the housing is impractical lest this change interferes with the operation of the draft gear or requires modification of the draft gear thus destroying the operational characteristics of the draft gear. The problem is to strengthen the housing within the limitations of available space and at the same time preserve the gear structure and operation as above described in the prior art device.

Strengthening of the draft gear housing to improve fatigue life without enlarging the outside dimensions and without interfering with the structure and operation of the draft gear apparatus is generally accomplished as described immediately below.

First, the ribs serving as guides for the main coil spring have been increased in section so as to provide the additional functions of supporting members for the draft gear rear end or wall, and, further, to serve as more effective stiffeners to increase the rigidity of the housing side walls.

Second, the radii of those internal portions of the housing by which the side walls and ribs are integrally blended with the housing end have increased to improve the continuity of isostrain lines and to reduce stress concentration.

Figure 27:
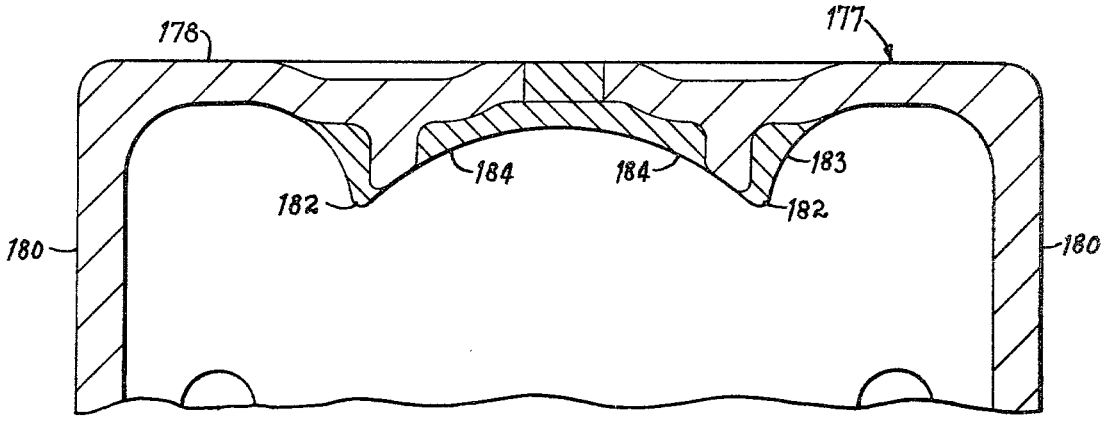
Fig-27 PRIOR ART

Third, a blend area has been added between the main coil spring guide ribs extending forwardly from the interior of the housing rear wall to substantially the midpoint of the housing to increase the bottom and top wall thicknesses to reduce flexure, and, also to better distribute the loading on the rear wall more uniformly throughout the top, bottom, and side walls of the housing. For example, at a section 1.38 inches from the outside of the rear of the housing, as shown in FIG. 27, the critical area has been increased 67% and the moment of inertia has been increased 56%. At a section 3 inches from the outside of the rear of the housing, the critical area has been increased 40% and the moment of inertia has been increased 19%.

It is to be noted that the cumulative effect of the above described first, second and third additions of material to the inside of the housing is to reduce the distance from the point of load application from the yoke on the rear wall to the neutral axis of the housing side walls which reduces the bending moment on the housing, which, in turn, reduces the amount of flexure of the housing under the draft-buff cycle and, therefore, improves fatigue characteristics.

Before particularly describing the detailed structure of the present invention, it will be noted that the invention as disclosed in FIGS. 21 through 28 relates to a draft gear housing having a relatively shorter length, compared with the width and length dimensions of the above-described housing shown in the prior art. Therefore, it will be understood that the improvements in the housing, which improvements constitute the present invention, are equally applicable to a longer housing, such as that shown in the above-identified prior art, as well as to the present housing which is dimensioned externally to fit into a standard pocket.

In order to more particularly describe the structure generally described in the first, second and third modifications above set forth, reference is made to FIGS. 20 through 28.

The draft gear housing, generally indicated at 177, is an oblong, rectangular, hollow steel casting having top, bottom, side and end walls 178, 179, 180 and 181, respectively. It will be understood that the internal construction of housing 177 is such that all the draft gear parts in the above identified prior art patent as disclosed in FIGS. 1 through 19 are disposed therein the same relative locations and cooperative relationships. Therefore, the following description will be limited to those internal constructions of the housing which are different from corresponding internal construction in the prior art housing of FIGS. 1 through 19 and which comprise the present invention.

Figure 20:
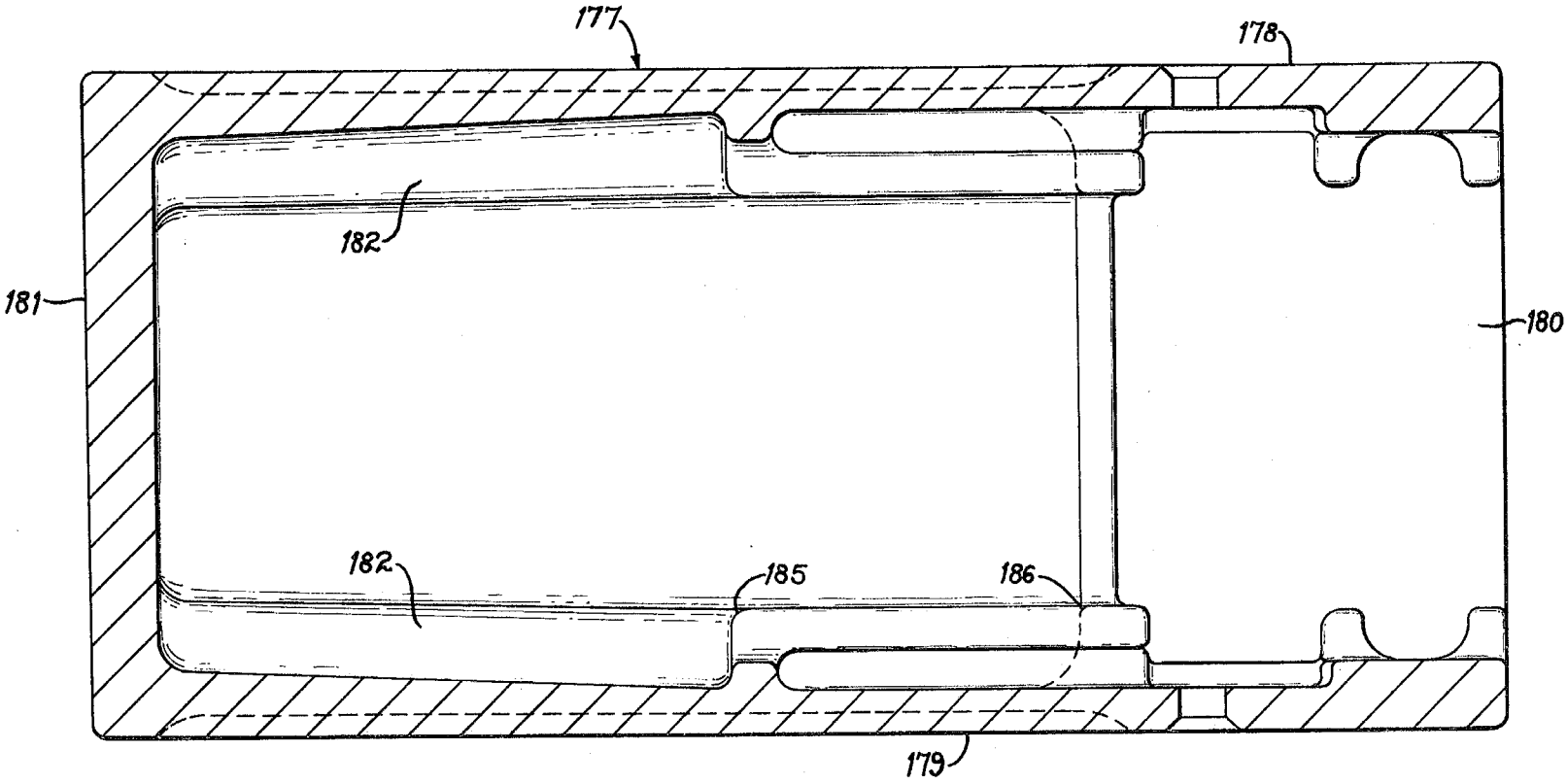
Figure 21:
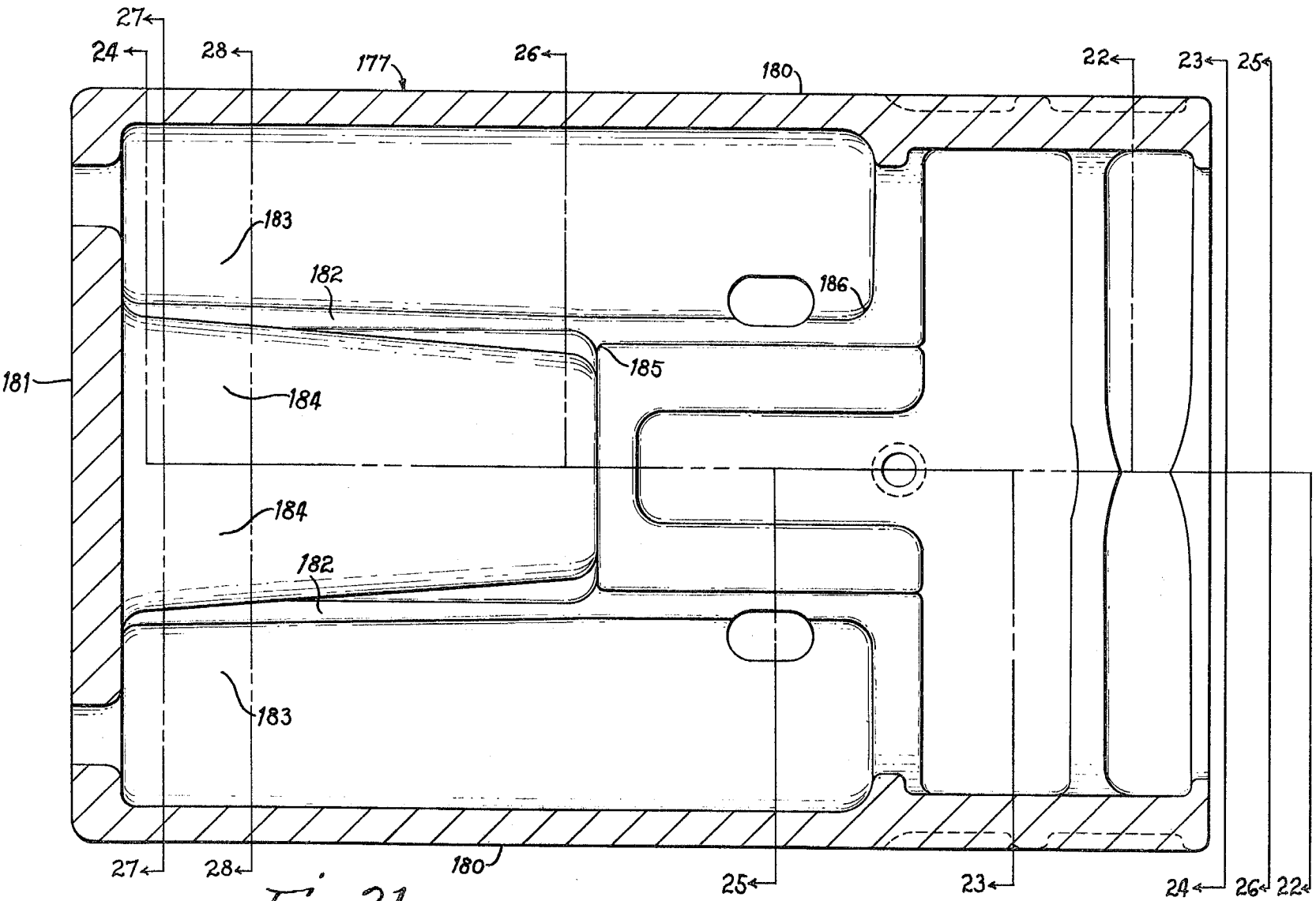
Figure 22:
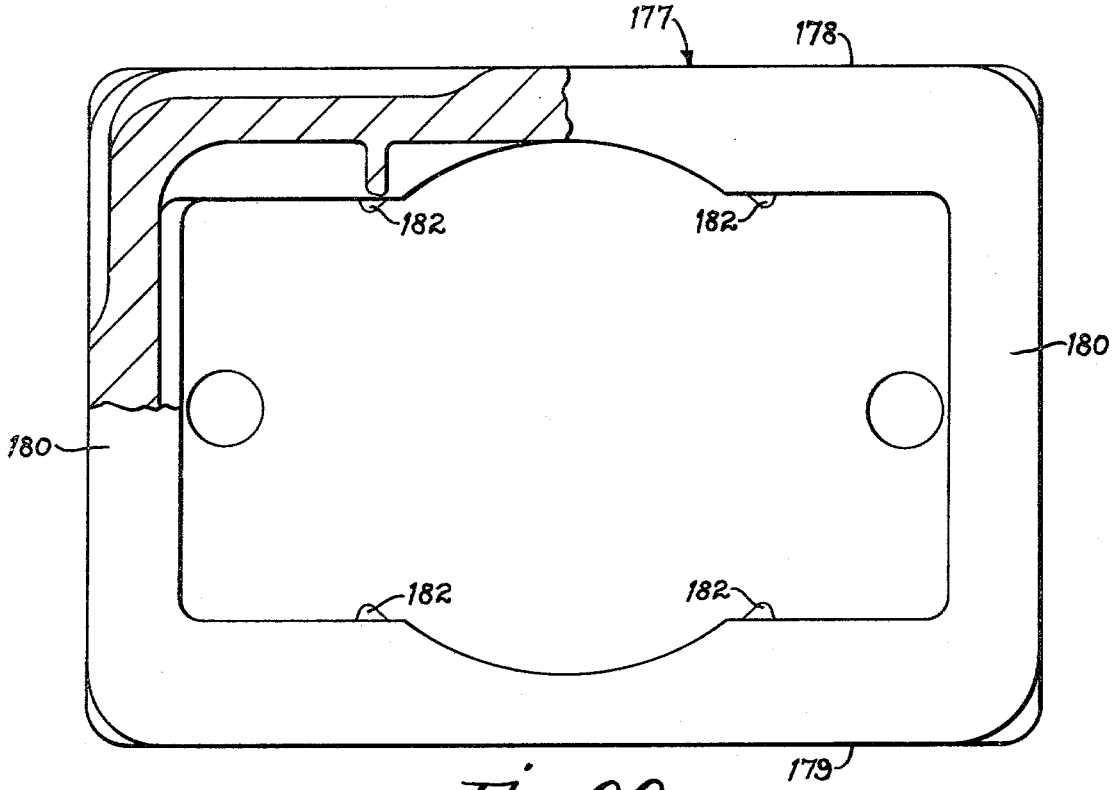
Figure 23:
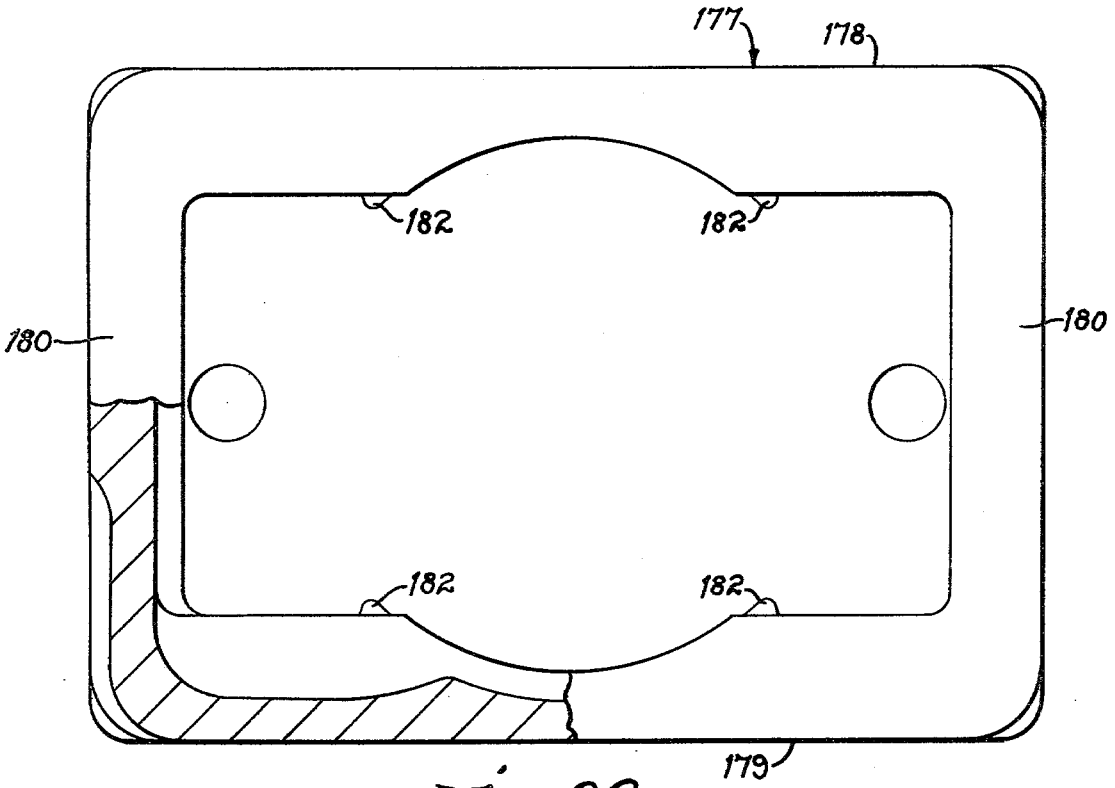
Figure 24:
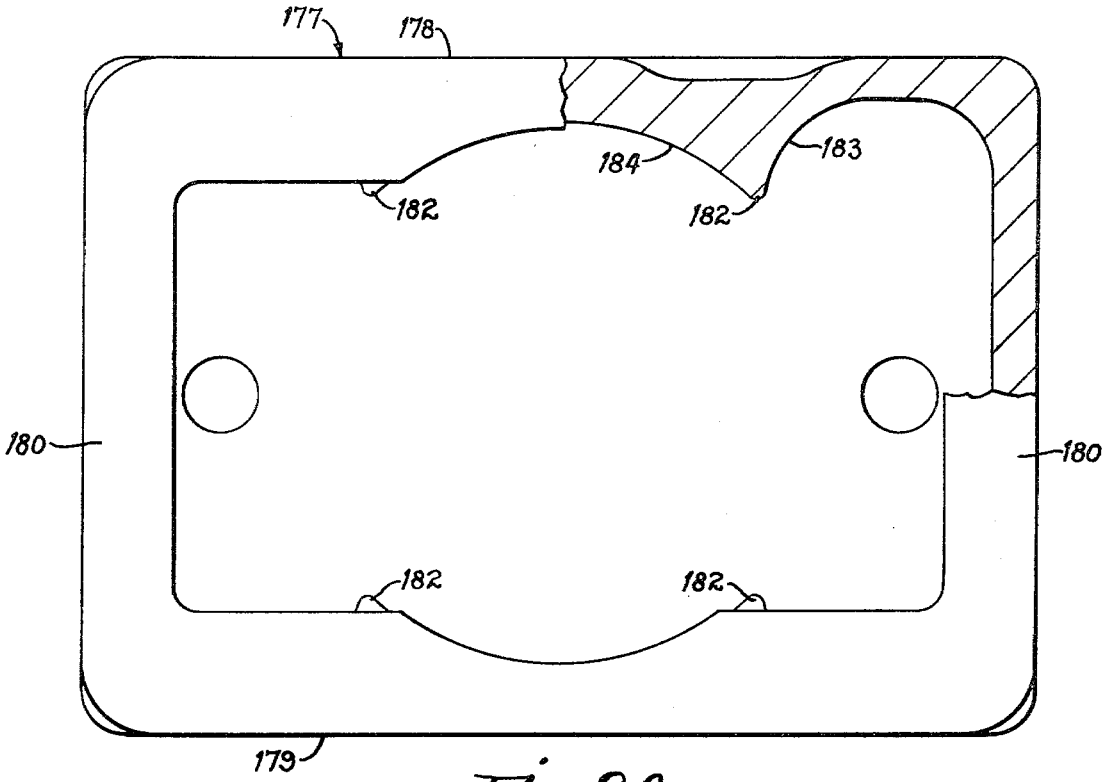
Figure 25:
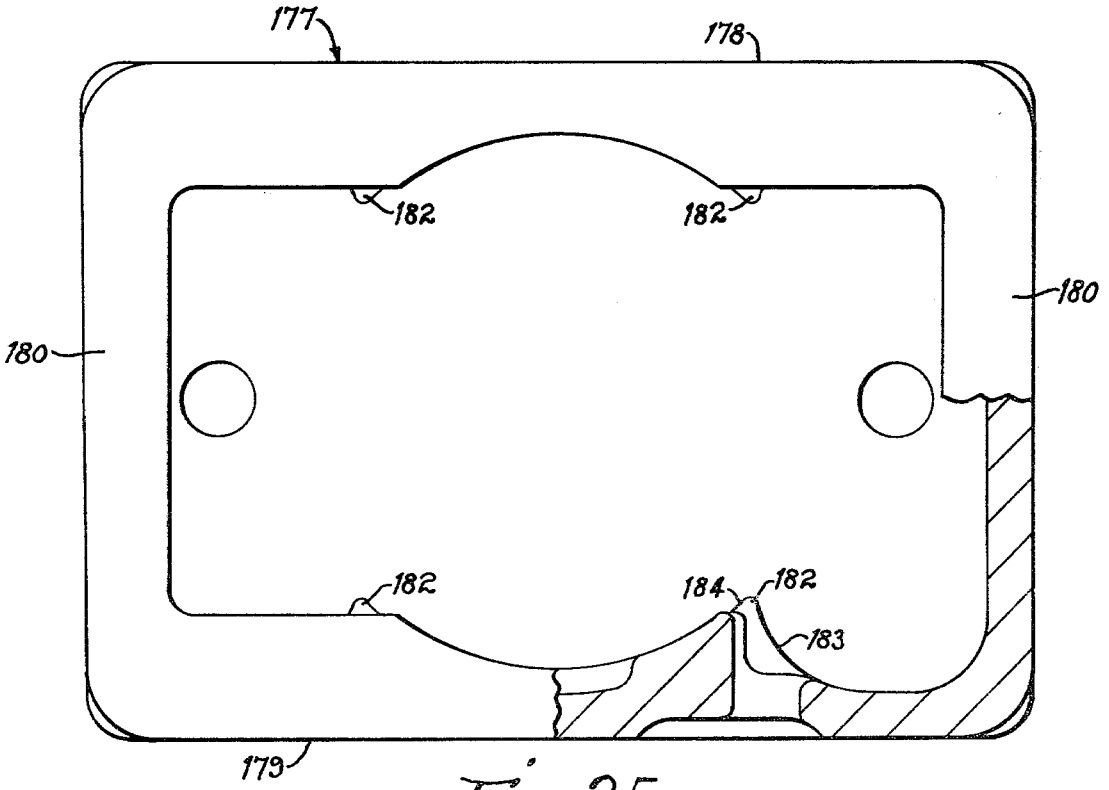
Figure 26:
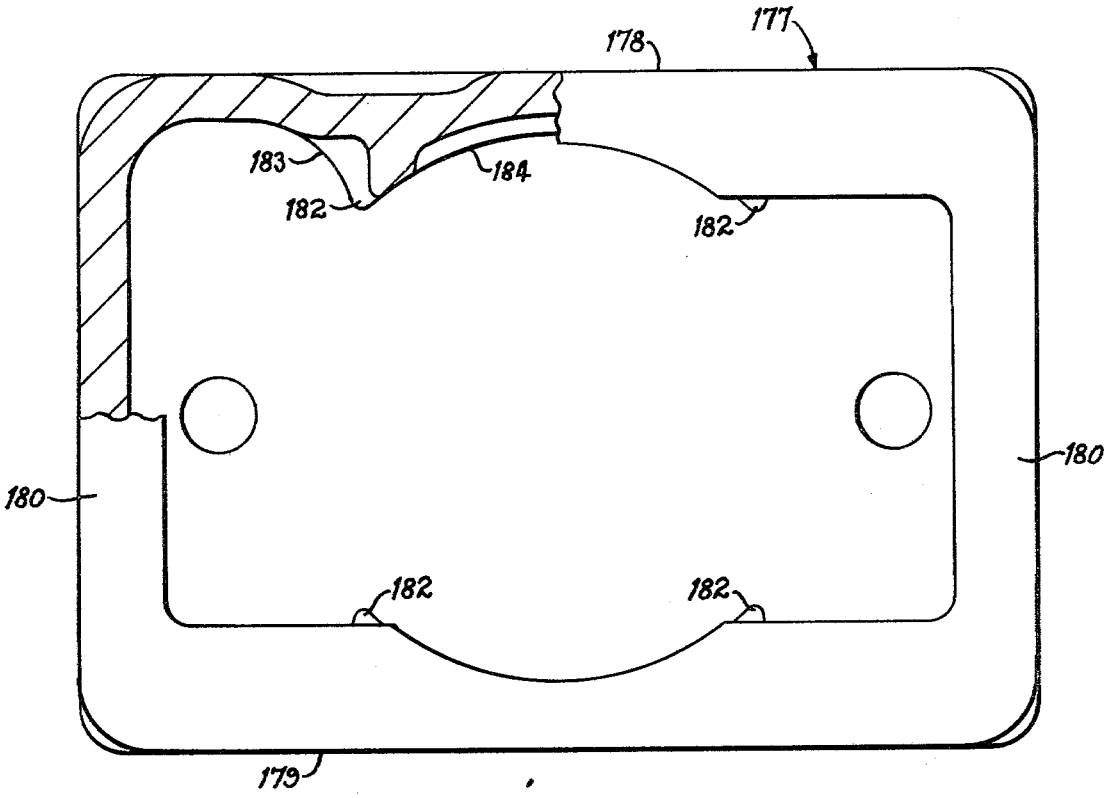
Figure 28:
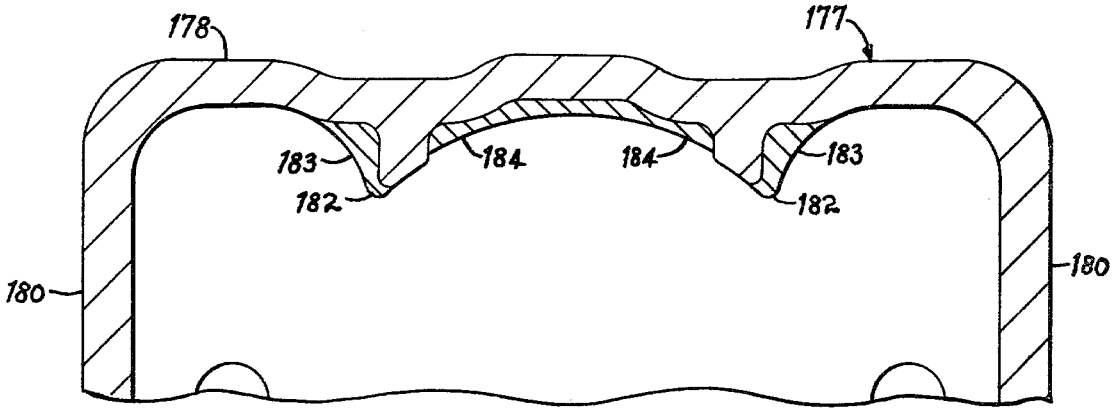
Fig-28 PRIOR ART

Referring now to FIGS. 20 through 26, the longitudinally disposed rib members 182 each comprise a pair of opposing arcuate sides 183, 184 intersecting to comprise the peak of the rib, the center of curvature of the sides 183 being substantially coincident with the axis of the corner springs 39, as shown in FIG. 3, on a radius slightly larger than the corner spring radius taken to the outside of the corner spring, thus providing clearance between the corner spring and the rib member 182. The center of curvature of sides 184 is substantially coincident with the axis of the main coil spring 34, as shown in FIG. 3, on a radius slightly larger than the radius to the outside of the main coil spring, thus providing clearance between the main coil spring and sides 184. The radius of curvature of sides 184 gradually increases from the inside of rear wall 181 forward to point 185, as shown in FIGS. 20 and 21 of the drawing, or, stated conversely, the radius of curvature of sides 184 tapers from front to rear to thereby add more material to the interior of the rear of the housing. The aforementioned taper is best seen in FIG. 20 on the interior of the housing on top and bottom walls 178 and 179, respectively. The gradual increase in the radius of curvature of side 184 from the inside of rear wall 181 forward to point 185 results in a double taper of each rib as now to be described. Referring to FIG. 21, it will be seen that various cross-sectional areas from back to point 185 of the housing are shown in FIGS. 24, 27, 28 and 26 taken consecutively. A comparison of each of these cross-sectional figures indicates that the height of the peak 182 of the rib above any given point in the housing gradually decreases from the rear point 185 of the housing. Inasmuch as the distance between the cross-sections of FIGS. 28 and 26 is greater along the length of the ribs than the distance between other consecutive cross-sections, the difference in the relative heights of the rib peak 182 above the base is more readily apparent. At the same time, it is readily seen that the gradual increase in radius of curvature of side 184 from the back of the housing to point 185 of the housing effects a gradual decrease in width of the rib at any predetermined point height above the base of the rib and taken parallel to the base, as shown, for example, in a comparison between the relative rib width as taken between FIGS. 27 and 28, the rib width of FIG. 28 being forward of, and smaller than, the rib width of FIG. 27. Thus, it will be noted that the cross-sectional area of the ribs becomes smaller proceeding from the rear wall to point 185, this portion designated as the rear portion of the ribs. The cross-sectional area of the ribs on the forward portion of the ribs, that is, from point 185 to end point 186, is narrowed and remains substantially the same.

In addition to the above, the radii of those integral portions of the housing which blend the housing rear to the side walls, and which blend the housing rear to the ribs have been increased over corresponding radii in the aforementioned prior art housing to reduce stress concentration as hereinbefore mentioned.

From the foregoing description, it will be readily apparent that the thickening of the guide ribs, particularly at the rear portion of the housing, provide support for the side walls and rear of the housing, without interfering with the operation of the draft gear disposed within the housing, to accomplish the desired resistance to flexing of the housing under draft stress provided by the yoke.

Having now described the invention, what I claim as new and desire to secure by Letters Patent is:

1. A draft gear housing of a generally rectangular cross section defined by a top wall, a bottom wall, a pair of opposing side walls, a rear wall and an open end opposite said rear wall; said top wall and said bottom wall having internally disposed thereon longitudinally extending strengthening ribs partially defining a main spring chamber and corner spring chambers, each of said ribs having a rear portion comprising a pair of opposing arcuate sides culminating at a peak, one of said arcuate sides of each rib partially defining one of said corner spring chambers, and the other of said arcuate sides of each rib partially defining said main spring chamber, said other of said arcuate side of each of said ribs gradually increasing in radius of curvature from said rear wall toward said open end so as to produce a decrease in both width and height of each said ribs.

2. A draft gear housing, as recited in claim 1, in which, the center of curvature of said one of said arcuate sides of each rib is disposed substantially coincident with a predetermined axis of one of said corner spring chambers.

3. A draft gear housing, as recited in claim 1, in which, the center of curvature of said other arcuate side of each said rib is disposed substantially coincident with a predetermined axis of said main spring chamber.

* * * * *